US007891430B2

(12) United States Patent
Willauer

(10) Patent No.: US 7,891,430 B2
(45) Date of Patent: Feb. 22, 2011

(54) WATER CONTROL DEVICE USING ELECTROMAGNETICS

(75) Inventor: Darrin L. Willauer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/875,558

(22) Filed: Oct. 19, 2007

(65) Prior Publication Data

US 2009/0101341 A1 Apr. 23, 2009

(51) Int. Cl.
*E21B 34/06* (2006.01)

(52) U.S. Cl. ..... 166/373; 166/66.5; 166/66.7; 166/386

(58) Field of Classification Search ..... 166/373, 166/66.5, 66.6, 66.7, 386
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,841 | A | 12/1946 | Spangler |
| 2,762,437 | A | 9/1956 | Egan et al. |
| 2,810,352 | A | 10/1957 | Tumilson |

(Continued)

FOREIGN PATENT DOCUMENTS

| | | |
|---|---|---|
| GB | 1492345 | 11/1977 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner*—Jennifer H Gay
*Assistant Examiner*—Elizabeth C Gottlieb
(74) *Attorney, Agent, or Firm*—Mossman, Kumar & Tyler, PC

(57) ABSTRACT

An apparatus for controlling a flow of fluid in a well includes a flow control device and a generator that generates electrical energy in response to a flow of an electrically conductive fluid. The flow control device may include an actuator receiving electrical energy from the generator, and a valve operably coupled to the actuator. The actuator may be configured to operate after a preset value for induced voltage is generated by the generator. The generator may use a pair of electrodes positioned along a flow path of the electrically conductive fluid to generate electrical energy. In one arrangement, one or more elements positioned proximate to the electrodes generate a magnetic field along the flow path of the electrically conductive fluid that causes the electrodes to generate a voltage. In another arrangement, the electrodes create an electrochemical potential in response to contact with the electrically conductive fluid.

20 Claims, 6 Drawing Sheets

U.S. PATENT DOCUMENTS

| | | | | |
|---|---|---|---|---|
| 2,814,947 | A | 12/1957 | Stegemeier et al. | |
| 2,942,668 | A | 6/1960 | Maly et al. | |
| 2,945,541 | A | 7/1960 | Maly et al. | |
| 3,326,291 | A | 6/1967 | Zandmer | |
| 3,385,367 | A | 5/1968 | Kollsman | |
| 3,419,089 | A | 12/1968 | Venghiattis | |
| 3,451,477 | A | 6/1969 | Kelley | |
| 3,675,714 | A | 7/1972 | Thompson | |
| 3,739,845 | A | 6/1973 | Berry et al. | |
| 3,791,444 | A | 2/1974 | Hickey | |
| 3,876,471 | A * | 4/1975 | Jones | 175/93 |
| 3,918,523 | A | 11/1975 | Stuber | |
| 3,951,338 | A | 4/1976 | Genna | |
| 3,975,651 | A | 8/1976 | Griffiths | |
| 4,153,757 | A | 5/1979 | Clark, III | |
| 4,173,255 | A | 11/1979 | Kramer | |
| 4,180,132 | A | 12/1979 | Young | |
| 4,186,100 | A | 1/1980 | Mott | |
| 4,187,909 | A | 2/1980 | Erbstoesser | |
| 4,248,302 | A | 2/1981 | Churchman | |
| 4,250,907 | A | 2/1981 | Struckman et al. | |
| 4,257,650 | A | 3/1981 | Allen | |
| 4,287,952 | A | 9/1981 | Erbstoesser | |
| 4,415,205 | A | 11/1983 | Rehm et al. | |
| 4,434,849 | A | 3/1984 | Allen | |
| 4,491,186 | A | 1/1985 | Alder | |
| 4,497,714 | A | 2/1985 | Harris | |
| 4,552,218 | A | 11/1985 | Ross et al. | |
| 4,572,295 | A | 2/1986 | Walley | |
| 4,614,303 | A | 9/1986 | Moseley, Jr. et al. | |
| 4,649,996 | A | 3/1987 | Kojicic et al. | |
| 4,821,800 | A | 4/1989 | Scott et al. | |
| 4,856,590 | A | 8/1989 | Caillier | |
| 4,917,183 | A | 4/1990 | Gaidry et al. | |
| 4,944,349 | A | 7/1990 | Von Gonten, Jr. | |
| 4,974,674 | A | 12/1990 | Wells | |
| 4,998,585 | A | 3/1991 | Newcomer et al. | |
| 5,004,049 | A | 4/1991 | Arterbury | |
| 5,016,710 | A | 5/1991 | Renard et al. | |
| 5,132,903 | A | 7/1992 | Sinclair | |
| 5,156,811 | A | 10/1992 | White | |
| 5,333,684 | A | 8/1994 | Walter et al. | |
| 5,337,821 | A | 8/1994 | Peterson | |
| 5,339,895 | A | 8/1994 | Arterbury et al. | |
| 5,377,750 | A | 1/1995 | Arterbury et al. | |
| 5,381,864 | A | 1/1995 | Nguyen et al. | |
| 5,431,346 | A | 7/1995 | Sinaisky | |
| 5,435,393 | A | 7/1995 | Brekke et al. | |
| 5,435,395 | A | 7/1995 | Connell | |
| 5,439,966 | A | 8/1995 | Graham et al. | |
| 5,551,513 | A | 9/1996 | Surles et al. | |
| 5,586,213 | A | 12/1996 | Bridges et al. | |
| 5,597,042 | A | 1/1997 | Tubel et al. | |
| 5,609,204 | A | 3/1997 | Rebardi et al. | |
| 5,673,751 | A | 10/1997 | Head et al. | |
| 5,803,179 | A | 9/1998 | Echols | |
| 5,831,156 | A | 11/1998 | Mullins | |
| 5,839,508 | A * | 11/1998 | Tubel et al. | 166/65.1 |
| 5,873,410 | A | 2/1999 | Iato et al. | |
| 5,881,809 | A | 3/1999 | Gillespie et al. | |
| 5,896,928 | A | 4/1999 | Coon | |
| 5,982,801 | A | 11/1999 | Deak | |
| 6,068,015 | A | 5/2000 | Pringle | |
| 6,098,020 | A | 8/2000 | Den Boer | |
| 6,112,815 | A | 9/2000 | Boe et al. | |
| 6,112,817 | A | 9/2000 | Voll | |
| 6,119,780 | A | 9/2000 | Christmas | |
| 6,228,812 | B1 | 5/2001 | Dawson et al. | |
| 6,253,843 | B1 | 7/2001 | Rawson et al. | |
| 6,253,847 | B1 * | 7/2001 | Stephenson | 166/248 |
| 6,253,861 | B1 | 7/2001 | Carmichael et al. | |
| 6,273,194 | B1 | 8/2001 | Hiron | |
| 6,305,470 | B1 | 10/2001 | Woie | |
| 6,325,153 | B1 | 12/2001 | Harrell | |
| 6,338,363 | B1 | 1/2002 | Chen et al. | |
| 6,367,547 | B1 | 4/2002 | Towers et al. | |
| 6,371,210 | B1 | 4/2002 | Bode et al. | |
| 6,372,678 | B1 | 4/2002 | Youngman et al. | |
| 6,419,021 | B1 | 7/2002 | George et al. | |
| 6,474,413 | B1 | 11/2002 | Barbosa et al. | |
| 6,505,682 | B2 | 1/2003 | Brockman | |
| 6,516,888 | B1 | 2/2003 | Gunnerson et al. | |
| 6,581,681 | B1 | 6/2003 | Zimmerman et al. | |
| 6,581,682 | B1 | 6/2003 | Parent et al. | |
| 6,622,794 | B2 | 9/2003 | Zisk | |
| 6,632,527 | B1 | 10/2003 | McDaniel et al. | |
| 6,635,732 | B2 | 10/2003 | Mentak | |
| 6,667,029 | B2 | 12/2003 | Zhong et al. | |
| 6,679,324 | B2 | 1/2004 | Boer et al. | |
| 6,692,766 | B1 | 2/2004 | Rubinstein et al. | |
| 6,699,503 | B1 | 3/2004 | Sako et al. | |
| 6,699,611 | B2 | 3/2004 | Kim et al. | |
| 6,786,285 | B2 | 9/2004 | Johnson et al. | |
| 6,817,416 | B2 | 11/2004 | Wilson et al. | |
| 6,840,321 | B2 | 1/2005 | Restarick et al. | |
| 6,857,476 | B2 | 2/2005 | Richards | |
| 6,863,126 | B2 | 3/2005 | McGlothen et al. | |
| 6,938,698 | B2 | 9/2005 | Coronado | |
| 6,951,252 | B2 | 10/2005 | Restarick et al. | |
| 6,976,542 | B2 | 12/2005 | Henriksen et al. | |
| 7,011,076 | B1 | 3/2006 | Weldon et al. | |
| 7,084,094 | B2 | 8/2006 | Gunn et al. | |
| 7,159,656 | B2 | 1/2007 | Eoff et al. | |
| 7,185,706 | B2 | 3/2007 | Freyer | |
| 7,290,606 | B2 | 11/2007 | Coronado et al. | |
| 7,318,472 | B2 | 1/2008 | Smith | |
| 7,322,412 | B2 | 1/2008 | Badalamenti et al. | |
| 7,325,616 | B2 | 2/2008 | Lopez de Cardenas et al. | |
| 7,395,858 | B2 | 7/2008 | Barbosa et al. | |
| 7,409,999 | B2 | 8/2008 | Henriksen et al. | |
| 7,673,678 | B2 | 3/2010 | MacDougall et al. | |
| 2002/0020527 | A1 | 2/2002 | Kilaas et al. | |
| 2002/0125009 | A1 | 9/2002 | Wetzel et al. | |
| 2003/0221834 | A1 | 12/2003 | Hess et al. | |
| 2004/0052689 | A1 | 3/2004 | Yao | |
| 2004/0144544 | A1 | 7/2004 | Freyer | |
| 2004/0194971 | A1 | 10/2004 | Thomson | |
| 2005/0016732 | A1 | 1/2005 | Brannon et al. | |
| 2005/0126776 | A1 | 6/2005 | Russell | |
| 2005/0171248 | A1 | 8/2005 | Li et al. | |
| 2005/0178705 | A1 | 8/2005 | Broyles et al. | |
| 2005/0189119 | A1 | 9/2005 | Gynz-Rekowski | |
| 2005/0199298 | A1 | 9/2005 | Farrington | |
| 2005/0207279 | A1 * | 9/2005 | Chemali et al. | 367/83 |
| 2005/0241835 | A1 | 11/2005 | Burris et al. | |
| 2006/0042798 | A1 | 3/2006 | Badalamenti et al. | |
| 2006/0048936 | A1 | 3/2006 | Fripp et al. | |
| 2006/0048942 | A1 | 3/2006 | Moen et al. | |
| 2006/0076150 | A1 * | 4/2006 | Coronado et al. | 166/386 |
| 2006/0086498 | A1 | 4/2006 | Wetzel et al. | |
| 2006/0108114 | A1 | 5/2006 | Johnson | |
| 2006/0175065 | A1 | 8/2006 | Ross | |
| 2006/0185849 | A1 | 8/2006 | Edwards et al. | |
| 2006/0272814 | A1 | 12/2006 | Broome et al. | |
| 2007/0012444 | A1 | 1/2007 | Horgan et al. | |
| 2007/0039741 | A1 | 2/2007 | Hailey, Jr. | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2008/0035350 | A1 | 2/2008 | Henriksen et al. | |
| 2008/0053662 | A1 * | 3/2008 | Williamson et al. | 166/381 |

| | | | |
|---|---|---|---|
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0236839 | A1 | 10/2008 | Oddie |
| 2008/0236843 | A1 | 10/2008 | Scott et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0133869 | A1 | 5/2009 | Clem |
| 2009/0133874 | A1 | 5/2009 | Dale et al. |
| 2009/0139727 | A1 | 6/2009 | Tanju et al. |
| 2009/0205834 | A1 | 8/2009 | Garcia et al. |

FOREIGN PATENT DOCUMENTS

| | | | |
|---|---|---|---|
| GB | 2341405 | | 12/2007 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | WO 2006/015277 | | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Restarick, Henry; Horizontal Completion Options in Reservoirs With Sand Problems; Halliuburton Energy Services; SPE 29831, Copyright 1995; Society of Petroleum Engineers Inc.

Dikken, Ben J.; Pressure Drip in Horizontal Wells and Its Effect on Production Performance; SPE, Koninklijke/Shell E&P Laboratorium; Nov. 1990.

"Rapid Swelling and Deswelling of Thermoreversible Hydrophobically Modified Poly(N-Isopropylacrylamide) Hydrogels Prepared by Freezing Polymerisation". Xue. W., Hamley, I. W. and Huglin, M. B., 2002. 43(1) 5181-5186.

"Thermoreversible Swelling Behavior of Hydrogeia Based on N-isopropylacrylamide with a Zwitterionic Comonomer", Xue. W, Champ. S. and Huglin, M. B. 2001, European Polymer Journal, 37(5) 869-875.

Dinarvand, R., D'Emanuele, A (1995) The use of thermoresponsive hydrogels for on-off release of molecules, J. Control. Rel. 36: 221-227.

Tanaka, T., Nishio, I., Sun, S.T., Ueno-Nishio, S. (1982) Collapse of gels in an electric field, Science. 216:467-469.

Ishihara,K., Hamada, N., Sato. S., Shinohara, I., (1964) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules. 17: 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

WATER CONTROL DEVICE USING ELECTROMAGNETICS

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of fluid between a wellbore tubular and a wellbore annulus. In one embodiment, the apparatus includes a flow control device that controls fluid flow in response to signals from a generator that generates electrical energy in response to a flow of an electrically conductive fluid. Because hydrocarbons fluids are not electrically conductive, no electrical energy is generated by the flow of hydrocarbons. In contrast, fluids such as brine or water are electrically conductive and do cause the generator to generate electrical energy. Thus, the flow control device may be actuated between an open position and a closed position in response to an electrical property of a flowing fluid.

In one embodiment, the flow control device may include an actuator receiving electrical energy from the generator, and a valve operably coupled to the actuator. The actuator may be a solenoid, a pyrotechnic element, a heat-meltable element, a magnetorheological element, and/or an electrorheological element. In certain embodiments, the actuator operates after a preset value for induced voltage is generated by the generator. In other embodiments, the flow control device may include circuitry configured to detect the electrical energy from the generator, and actuate a valve in response to the detection of a predetermined voltage value. In some arrangements, the actuator may include an energy storage element that stores electrical energy received from the generator and/or a power source configured to supply power to the actuator.

In aspects, the generator may use a pair of electrodes positioned along a flow path of the electrically conductive fluid to generate electrical energy. In one arrangement, one or more elements positioned proximate to the pair of electrodes generate a magnetic field along the flow path of the electrically conductive fluid that causes the electrodes to generate a voltage. In another arrangement, the pair of electrodes creates an electrochemical potential in response to contact with the electrically conductive fluid. In such embodiments, the pair of electrodes may include dissimilar metals.

In aspects, the present disclosure provides a method for controlling a flow of fluid between a wellbore tubular and a wellbore annulus. The method may include controlling the flow of fluid between the wellbore tubular and the wellbore annulus using a flow control device, and activating the flow control device using electrical energy generated by a flow of an electrically conductive fluid. In aspects, the method may also include generating the electrical energy using a generator and storing the electrical energy in a power storage element. In aspects, the method may include generating electrical energy using a generator; detecting electrical energy from the generator; and activating the flow control device upon detecting a predetermined voltage value.

In certain embodiments, the method may include generating electrical energy by positioning a pair of electrodes positioned along a flow path of the electrically conductive fluid; and positioning at least one element proximate to the pair of electrodes to generate a magnetic field along a flow path of the electrically conductive fluid. In other embodiments, electrical energy may be generated by positioning a pair of electrodes along a flow path of the electrically conductive fluid. The pair of electrodes may be electrically coupled to the flow control device and create an electrochemical potential in response to contact with the electrically conductive fluid.

In aspects, the present disclosure provides a method for control fluid flow in a well having a wellbore tubular. The method may include positioning a flow control device along the wellbore tubular; positioning a pair of electrodes along a flow of an electrically conductive fluid; generating an electrical signal using the pair of electrodes; and actuating the flow control device using the generated electrical signal.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
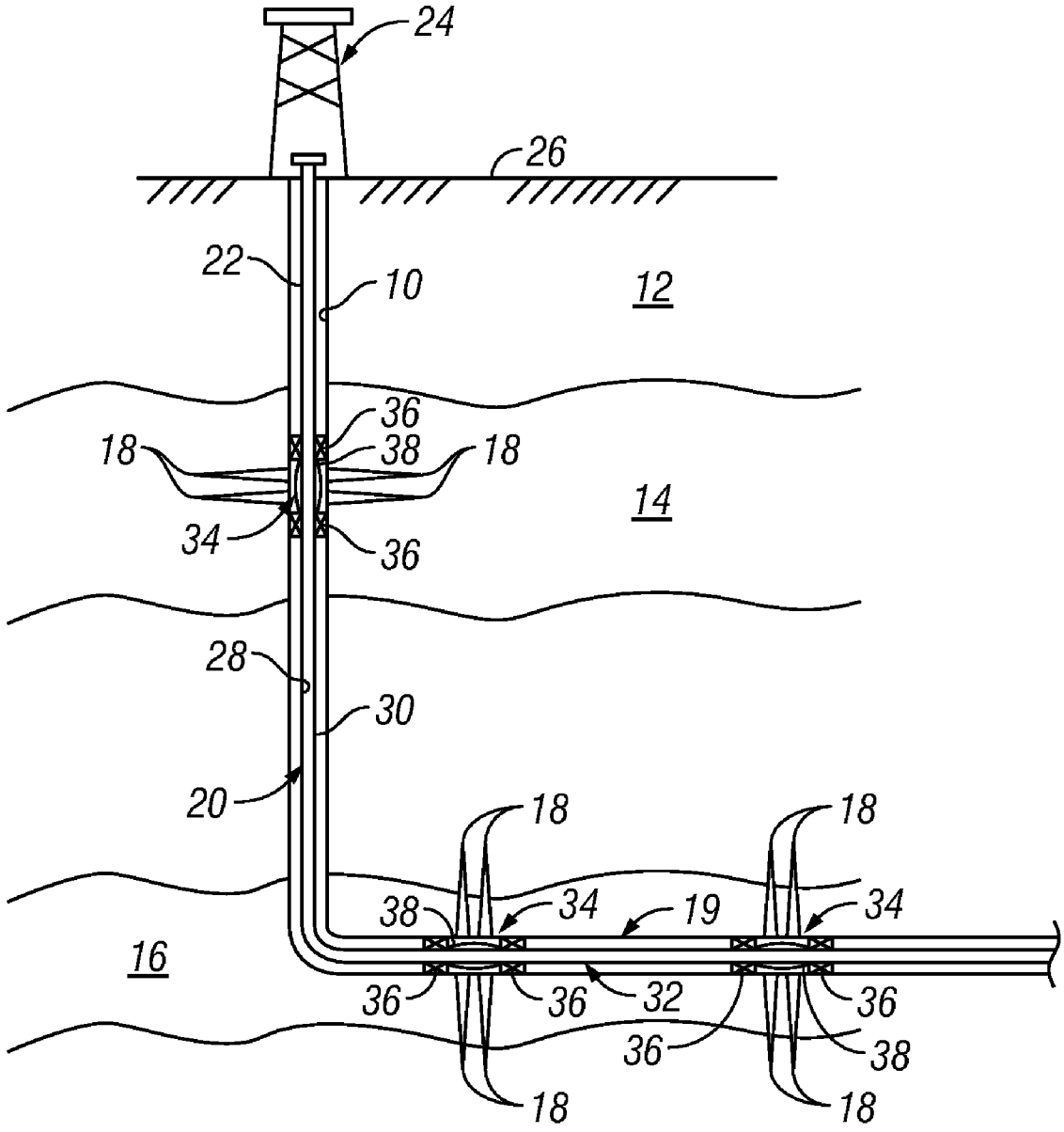
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14,16 from which it is desired to produce hydrocarbons. The wellbore 10 is cased by metal casing, as is known in the art, and a number of perforations 18 penetrate and extend into the formations 14,16 so that production fluids may flow from the formations 14,16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
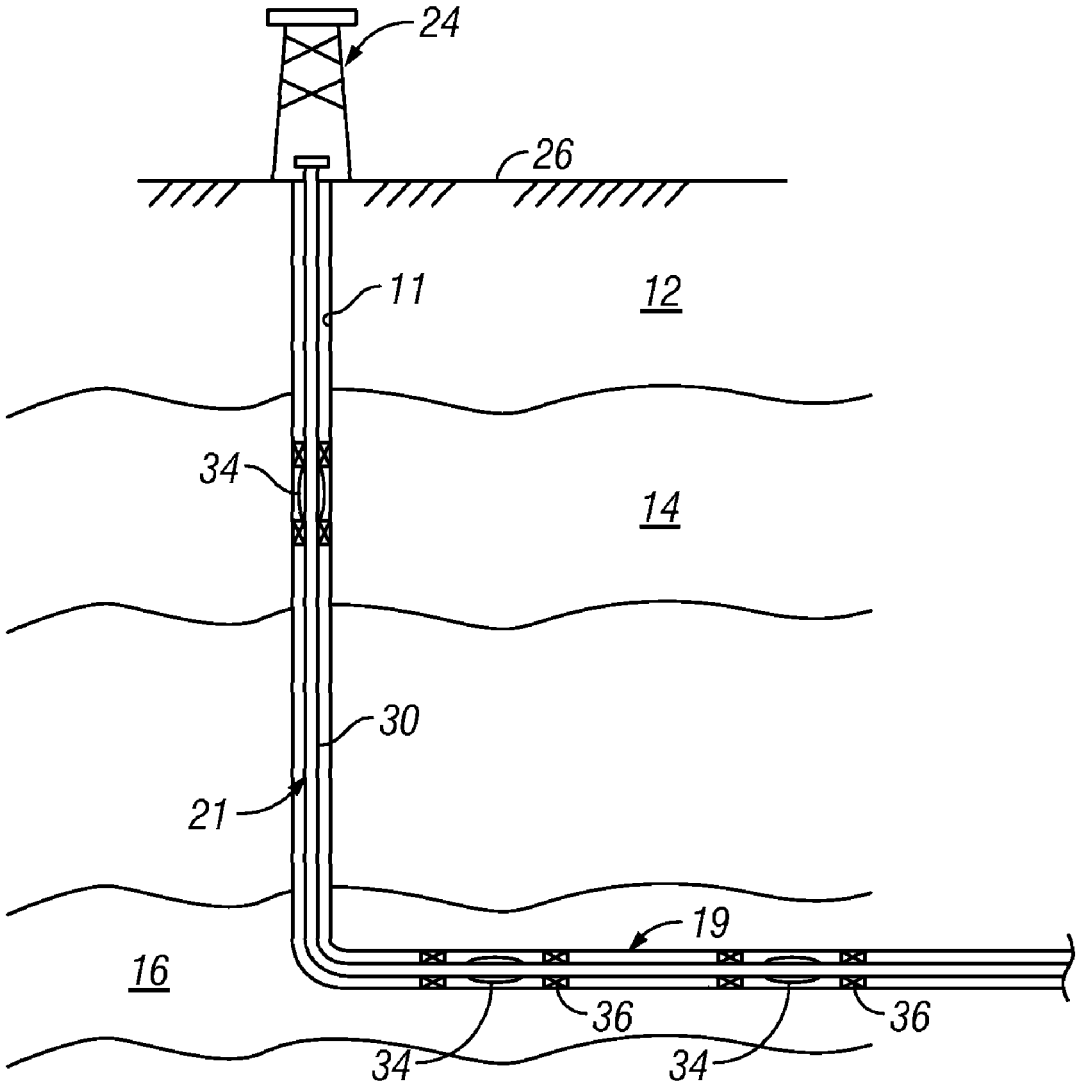
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
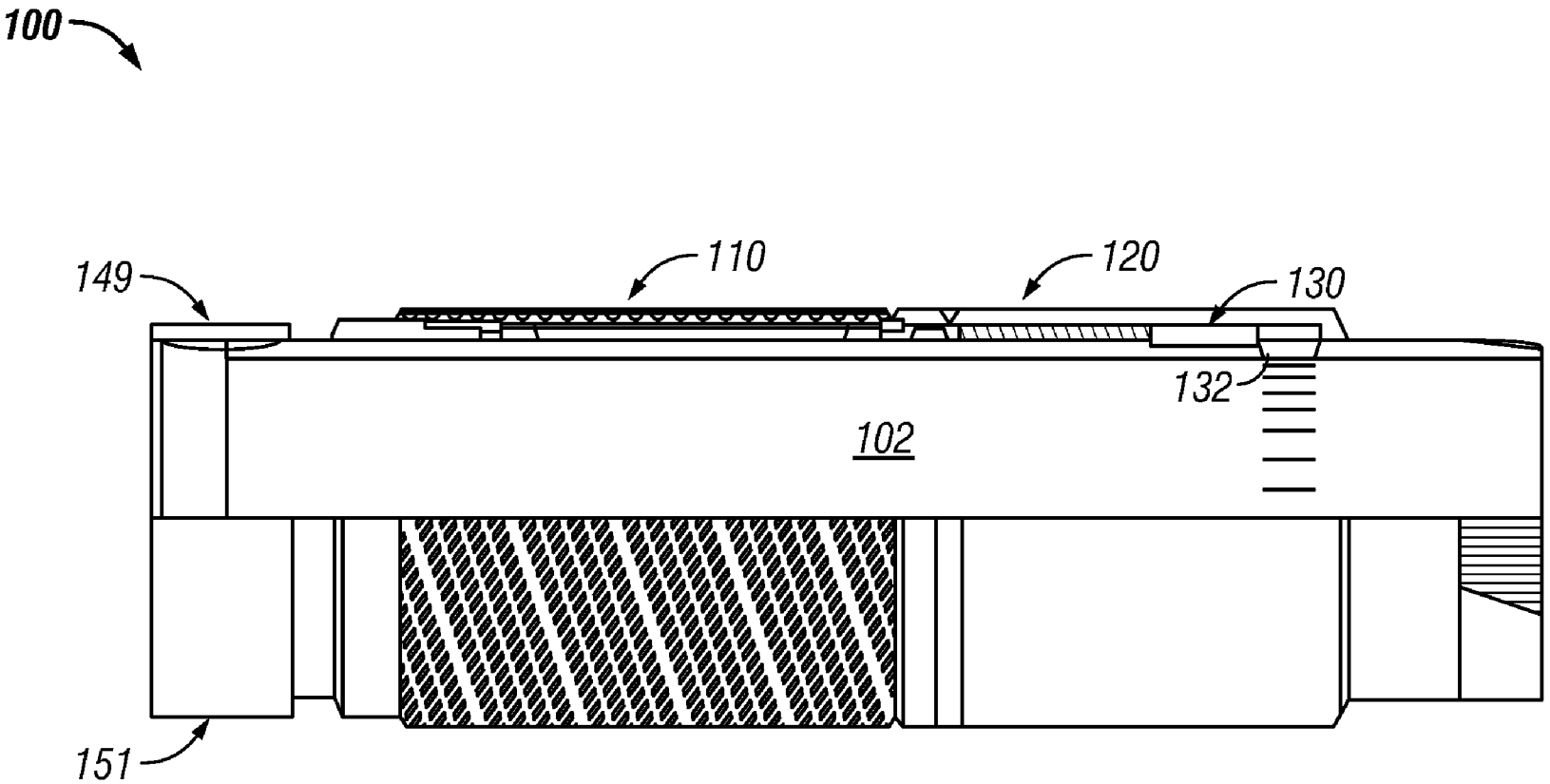
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a wellbore tubular (e.g., tubing string 22 of FIG. 1). This flow control may be a function of water content. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary devices for controlling one or more aspects of production are discussed herein below.

In one embodiment, the production control device 100 includes a particulate control device 110 for reducing the amount and size of particulates entrained in the fluids, an in-flow control device 120 that controls overall drainage rate from the formation, and an in-flow fluid control device 130 that controls in-flow area based upon a water content of the fluid in the production control device. The particulate control device 110 can include known devices such as sand screens and associated gravel packs.

Figure 4:
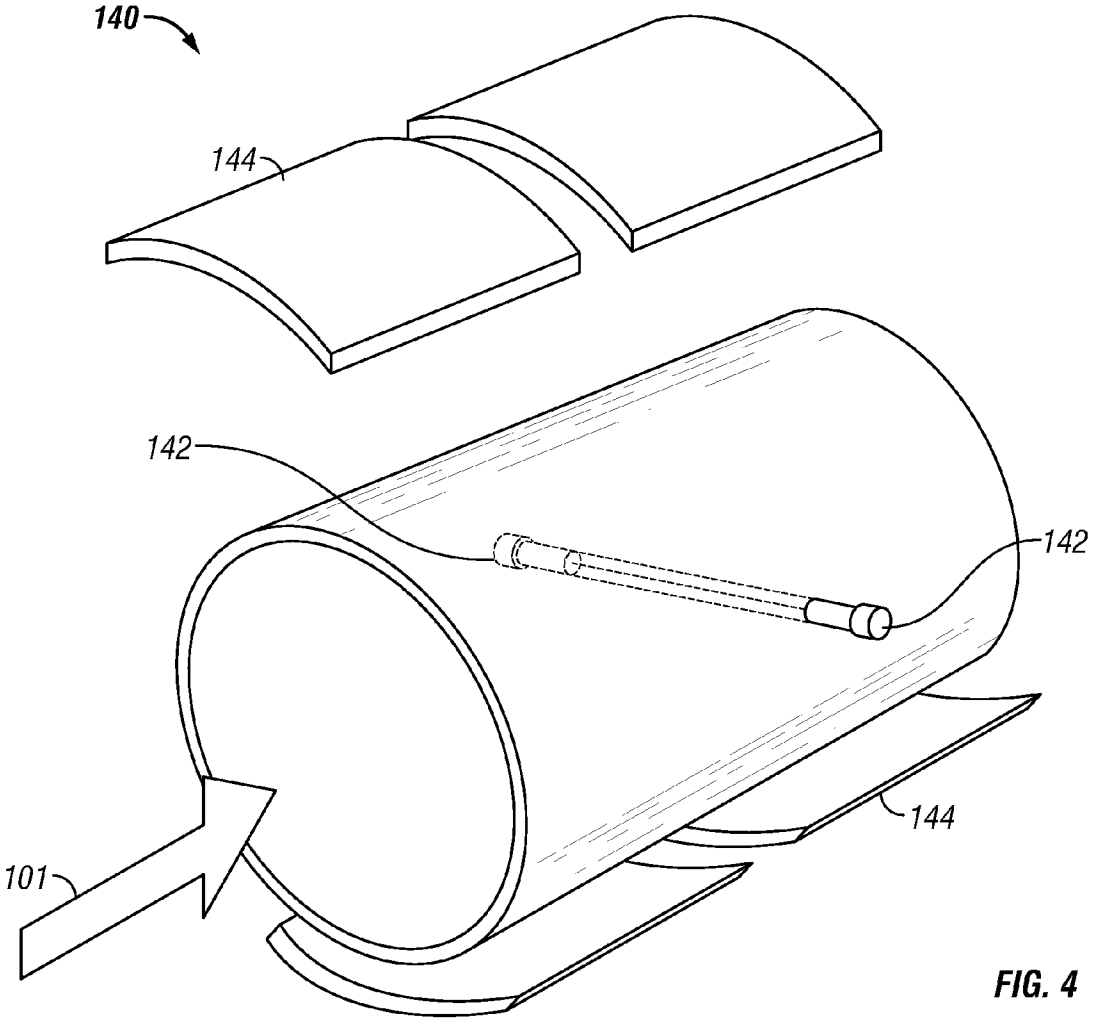
FIG. 4 is an isometric view of an illustrative power generator made in accordance with one embodiment of the present disclosure.

Referring now to FIG. 4, there is shown a downhole generator 140 that utilizes Faraday's Law to induce a voltage that may be used to energize or activate one or more flow control devices 130 (FIG. 3). Faraday's Law states that when a conductor is moved through a magnetic field, it will produce a voltage proportional to the relative velocity of the conductor through the magnetic field, i.e., $E \propto V*B*d$; where E=Induced Voltage; V=Average Liquid Velocity; B=Magnetic Field; and d=distance between electrodes, which is representative of the cross-sectional flow area. In embodiments, the downhole generator 140 includes one or more sets of two electrodes 142 and includes a coil 144 or other element configured to generate a magnetic field. Exemplary magnetic field generating elements may include, but are not limited to, permanent magnets, DC magnets, bars, magnetic elements, etc. The electrodes 142 and magnetic coils 144 are positioned along an inflow fluid flow path 101. Since hydrocarbons are substantially not electrically conductive, the flow of oil will generate only a nominal induce voltage. As the percentage of water in the flowing fluid increases, there will be a corresponding increase in fluid conductivity due to the electrical conductivity of water. Consequently, the induced voltage will increase as the percentage of water in the flowing fluid increases.

The downhole generator 140 may be used in connection with an in-flow control device in a variety of configurations. In some embodiments, the downhole generator 140 may generate sufficient electrical energy to energize a flow control device. That is, the downhole generator 140 operates as a primary power source for an in-flow control device. In other embodiments, the downhole generator 140 may generate electrical power sufficient to activate a main power source that energizes a flow control device. In still other embodiments, the downhole generator 140 may be used to generate a signal indicative of water in-flow. The signal may be used by a separate device to close a flow control device. Illustrative embodiments are discussed below.

Figure 5:
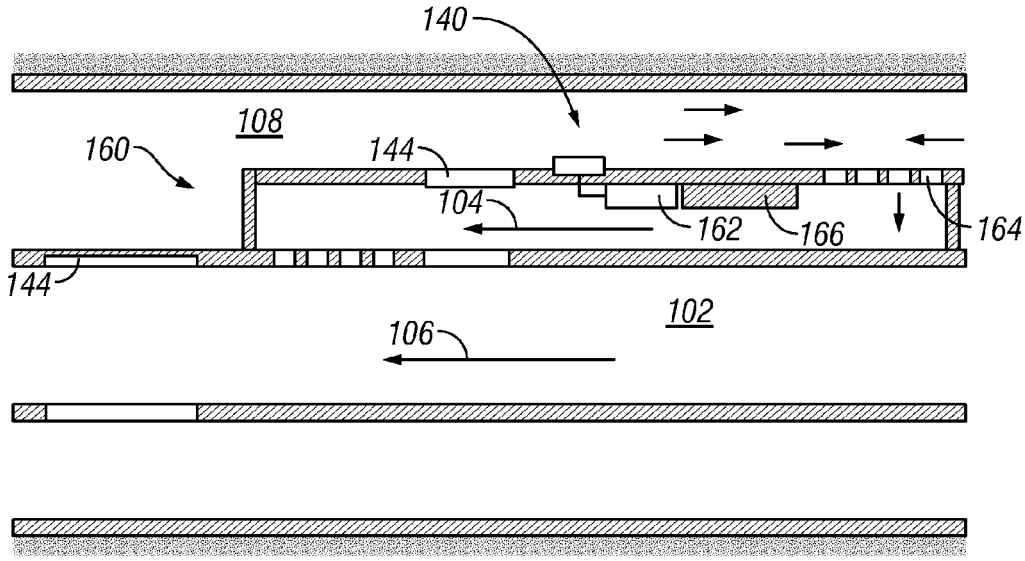
FIG. 5 is a schematic of an in-flow control device made in accordance with one embodiment of the present disclosure.

Referring now to FIG. 5, there is shown one embodiment of an inflow control device 160 that utilizes the above-described generator. The electrodes (not shown) and magnetic coils 144 of the generator 140 may be positioned along a fluid path 104 prior to entering the wellbore production flow and/or in a fluid path 106 along the flow bore 102. The power generator 140 energizes an actuator 162 that is configured to a device such as a valve 164. In one embodiment, the valve 164 is formed as a sliding element 166 that blocks or reduces flow from an annulus 108 of the wellbore into the flow bore 102. Other valve arrangements will be described in greater detail below.

In other embodiments, the downhole generator may generate a signal using an electrochemical potential of an electrically conductive fluid. For example, in one embodiment, the downhole generator may include two electrodes (not shown) of dissimilar metals such that an electrochemical potential is created when the electrodes come in contact with an electrically conductive fluid such as brine produced by the formation. Examples of electrode pairs may be, but not limited to, magnesium and platinum, magnesium and gold, magnesium and silver and magnesium and titanium. Manganese, zinc chromium, cadmium, aluminum, among other metals, may be used to produce an electrochemical potential when exposed to electrically conductive fluid. It should be understood that the listed materials have been mentioned by way of example, and are not exhaustive of the materials that may be used to generate an electrochemical potential.

Figure 6:
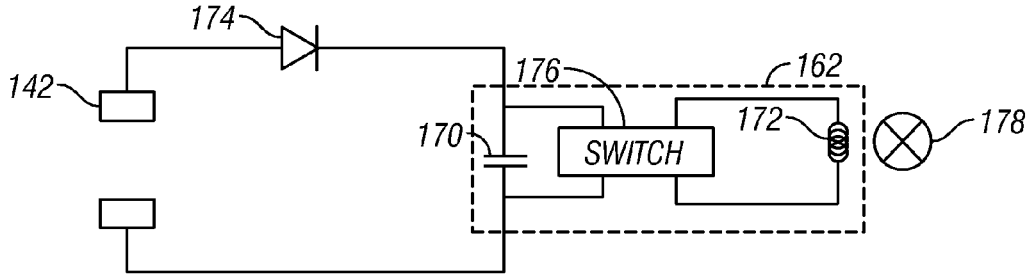
FIG. 6 is a schematic of an illustrative electrical circuit used in connection with one embodiment of an in-flow control device made in accordance with the present disclosure.

Referring now to FIG. 6, in one embodiment, the actuator 162 may include an energy storage device 170 such as a capacitor and a solenoid element 172. A diode 174 may be used to control current flow. For example, the diode 174 may require a preset voltage to be induced before current can start to flow to the capacitor. Once the current starts to flow due to increasing water cut, the capacitor 170 charges to store energy. In one arrangement, the capacitor 170 may be charged until a preset voltage is obtained. A switching element 176 may be used to control the discharge of the capacitor 170. Once this voltage is obtained, the energy is released to energize the solenoid element 172, which then closes a valve 178 to shut off fluid flow.

Figure 7:
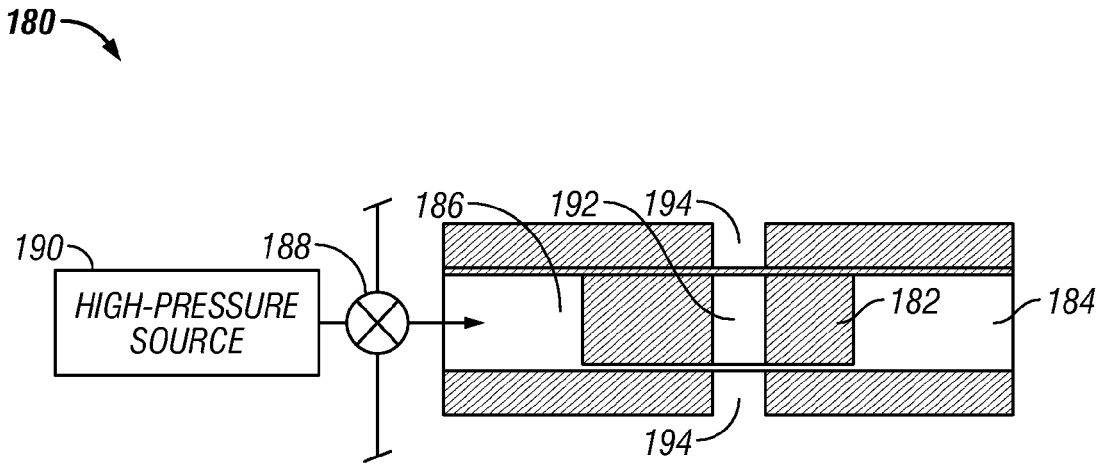
FIG. 7 is a schematic of an illustrative valve made in accordance with the present disclosure.

Referring now to FIG. 7, there is shown one embodiment of a valve 180 that may be actuated using power generated by the previously described downhole power generators. The valve 180 may be positioned to control fluid flow from or to an annulus 108 (FIG. 5) and a production flow bore 102 (FIG. 5). The valve 180 may be configured as a piston 182 that translates within a cavity having a first chamber 184 and a second chamber 186. A flow control element 188 selectively admits a fluid from a high pressure fluid source 190 to the second chamber 186. The piston 182 includes a passage 192 that in a first position aligns with passages 194 to permit fluid flow through the valve 180. When the passage 192 and passages 194 are misaligned, fluid flow through the valve 180 is blocked. In one arrangement, the passages 192 and 194 are aligned when the chambers 184 and 186 have fluid at substantially the same pressure, e.g., atmospheric pressure. When activated by a downhole power generator (e.g., the generator 140 of FIG. 4), the flow control element 188 admits high pressure fluid from the high-pressure fluid source 190 into the second chamber 186. A pressure differential between the two chambers 184 and 186 translates the piston 182 and causes a misalignment between the passages 192 and 194, which effectively blocks flow across the valve 180. The high pressure fluid source 190 may be a high-pressure gas in a canister or a fluid in the wellbore.

It should be understood that numerous arrangements may function as the flow control element 188. In some embodiments, the electrical power generated is used to energize a solenoid. In other arrangements, the electric power may be used in connection with a pyrotechnic device to detonate an explosive charge. For example, the high-pressure gas may be used to translate the piston 182. In other embodiments, the electrical power may be use to activate a "smart material" such as magnetostrictive material, an electrorheological fluid that is responsive to electrical current, a magnetorheological fluid that is responsive to a magnetic field, or piezoelectric materials that responsive to an electrical current. In one arrangement, the smart material may deployed such that a change in shape or viscosity can cause fluid to flow into the second chamber 186. Alternatively, the change in shape or viscosity can be used to activate the sleeve itself. For example, when using a piezoelectric material, the current can cause the material to expand, which shifts the piston and closes the ports.

Figure 8:
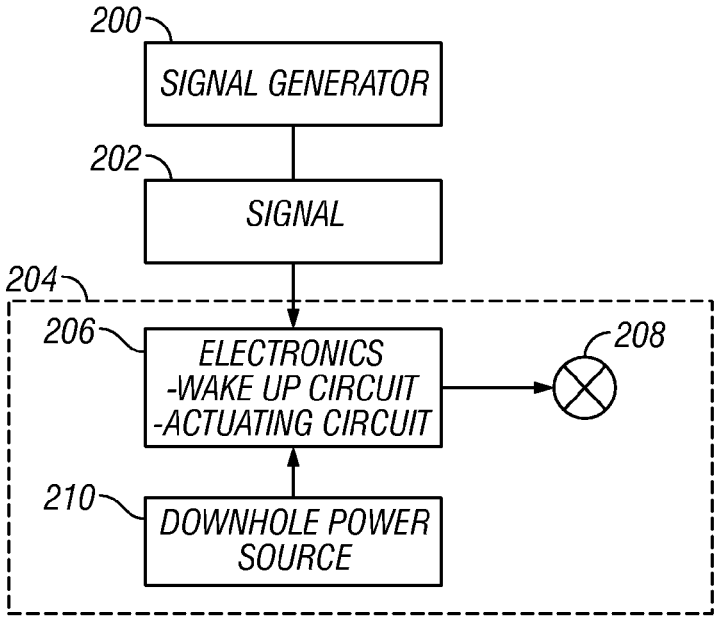
FIG. 8 is a schematic of an illustrative signal generator used in connection with one embodiment of an in-flow control device made in accordance with the present disclosure.

Referring now to FIG. 8, there is shown a downhole generator 200 may be used as a self-energized sensor for detecting a concentration of water in a fluid (water cut). The downhole generator 200 may transmit a signal 202 indicative of a water cut of a fluid entering an in-flow control device 204. The in-flow control device 204 may include electronics 206 having circuitry for actuating a flow control device 208 and circuitry for varying power states. The electronics 206 may be programmed to periodically "wake up" to detect whether the downhole generator 200 is outputting a signal at a sufficient voltage value to energize the flow control device 208. As described above, the voltage varies directly with the concentration of water in the flowing fluid. Such an arrangement may include a downhole power source 210 such as a battery for energizing the electronics and the valve. Once a sufficiently high level of water concentration is detected, the electronics 206 may actuate the flow control device 208 to restrict or stop the flow of fluid. While the periodic "wake ups" consume electrical power, it should be appreciated that no battery power is required to detect the water concentration of the flowing fluid. Thus, the life of a battery may be prolonged.

It should be understood that FIGS. 1 and 2 are intended to be merely illustrative of the production systems in which the teachings of the present disclosure may be applied. For example, in certain production systems, the wellbores 10,11 may utilize only a casing or liner to convey production fluids to the surface. The teachings of the present disclosure may be applied to control the flow into those and other wellbore tubulars.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a production fluid between a wellbore tubular and a formation, wherein the production fluid has an electrically conductive component and a non-electrically conductive component, the apparatus comprising:

a flow control device configured to control the flow of the production fluid between the wellbore tubular and the formation; and a generator coupled to the flow control device, the generator configured to generate both an electrical energy and an electrical signal in response to an increase in the flow of the electrically conductive component through a magnetic field, the generator activating the flow control device upon a preset concentration of the electrically conductive component being in the production fluid.

2. The apparatus according to claim 1 wherein the flow control device includes an actuator receiving the electrical signal from the generator.

3. The apparatus according to claim 2 wherein the actuator includes one of (i) a solenoid, (ii) a pyrotechnic element, (iii) a heat-meltable element, (iv) a magnetorheological element, (v) an electrorheological element.

4. The apparatus according to claim 2 wherein the actuator includes an energy storage element to store electrical energy received from the generator.

5. The apparatus according to claim 2 wherein the actuator is configured to operate after a preset value for induced voltage is generated by the generator.

6. The apparatus according to claim 2 further comprising a power source configured to supply power to the actuator.

7. The apparatus according to claim 1 wherein the flow control device includes circuitry configured to: (i) detect the electrical energy from the generator, and (ii) actuate a valve upon detecting a predetermined voltage value.

8. The apparatus according to claim 1 wherein the generator includes:

at least one element configured to generate the magnetic field along a flow path of the production fluid.

9. The apparatus according to claim 1 wherein the generator includes:

a plurality of electrodes positioned along a flow path of the production fluid, the plurality of electrodes being electrically coupled to the flow control device; and at least one element positioned proximate to the plurality of electrodes and being configured to generate the magnetic field along the flow path of the production fluid.

10. The apparatus according to claim 9 wherein the pair of electrodes includes dissimilar metals.

11. A method for controlling a flow of a production fluid between a wellbore tubular and a formation, wherein the production fluid has an electrically conductive component and a non-electrically conductive component, the method comprising:

flowing the production fluid from the formation into the wellbore;

controlling the flow of the production fluid between the wellbore tubular and the formation using a flow control device; and activating the flow control device upon a preset concentration of the electrically conductive fluid being in the production fluid and using electrical energy generated by the increasing flow of the electrically conductive component of the production fluid through a magnetic field.

12. The method according to claim 11 wherein the flow control device includes a valve that is coupled to an actuator that receives the electrical energy; and further comprising reducing the flow of the production fluid into the wellbore tubular as a concentration of water in the production fluid changes.

13. The method according to claim 12 wherein the actuator includes one of (i) a solenoid, (ii) a pyrotechnic element, (iii) a heat-meltable element, (iv) a magnetorheological element, (v) an electrorheological element.

14. The method according to claim 12 further comprising: generating the electrical energy using a generator; storing energy received from the generator in an energy storage element.

15. The method according to claim 12 further comprising: generating the electrical energy using a generator; and operating the actuator after a preset value for induced voltage is generated by the generator.

16. The method according to claim 12 further comprising supplying power to the actuator using a power source.

17. The method according to claim 11 further comprising:

generating electrical energy using a generator;

detecting electrical energy from the generator; and activating the flow control device upon detecting a predetermined voltage value.

18. The method according to claim 11 further comprising:

generating electrical energy by:

generating the magnetic field using at least one element positioned along a flow path of the electrically conductive production fluid.

19. The method according to claim 11 further comprising:

generating electrical energy by positioning a plurality of electrodes along a flow path of the production fluid, the plurality of electrodes being electrically coupled to the flow control device.

20. A method for controlling production fluid flow in a well having a wellbore tubular, wherein the production fluid has an electrically conductive component and a non-electrically conductive component, the method comprising:

positioning a flow control device along the wellbore tubular;

positioning a plurality of electrodes along a flow of the production fluid;

positioning at least one magnetic element along a flow of production fluid;

generating both an electrical signal and an electrical energy using the plurality of electrodes and the at least one magnetic element in response to an increase in the flow of the electrically conductive component; and actuating the flow control device using the generated electrical signal upon a preset concentration of the electrically conductive component flowing the flow control device.

* * * * *